United States Patent [19]

Kenney et al.

[11] Patent Number: 4,599,964

[45] Date of Patent: Jul. 15, 1986

[54] SAILBOAT HULL

[76] Inventors: Thomas A. Kenney, 42 Beacon St., Hull, Mass. 02045; Frederick W. Holbrow, 25 Congress St., Braintree, Mass. 02184

[21] Appl. No.: 685,243

[22] Filed: Dec. 21, 1984

[51] Int. Cl.[4] ..... B63B 39/02

[52] U.S. Cl. ..... 114/124; 114/126; 114/140

[58] Field of Search ..... 114/56, 57, 121, 124, 114/126, 140, 39.1

[56] References Cited

U.S. PATENT DOCUMENTS

| | | | |
|---|---|---|---|
| 189,420 | 4/1877 | Berghold | 114/124 |
| 1,331,202 | 2/1920 | Kitchen et al. | 114/124 |
| 1,595,949 | 8/1926 | Kirin | 114/140 |
| 2,218,264 | 10/1940 | Luce | 114/360 |
| 4,376,416 | 3/1983 | Carver | 114/140 |

FOREIGN PATENT DOCUMENTS

| | | | |
|---|---|---|---|
| 1472963 | 3/1967 | France | 114/140 |
| 53488 | 4/1979 | Japan | 114/140 |

*Primary Examiner*—Trygve M. Blix
*Assistant Examiner*—Stephen P. Avila
*Attorney, Agent, or Firm*—John P. McGonagle

[57] ABSTRACT

A new and improved sailboat hull for traditionally designed, single hull sailboats having a generally tapered lower hull section, whereby the lower hull section is extended rearward beneath the rudder to a point aft of the visible stern. The lower hull extension contains ballast so that the center of gravity of the sailboat is moved toward the stern. The lower hull extension is telescopically adjustable with a direct, corresponding effect on ballast. Horizontal fins extend laterally from either side of the lower hull extension which also has a trim tab attached to its aft end.

2 Claims, 6 Drawing Figures

SAILBOAT HULL

BACKGROUND OF THE INVENTION

This invention relates to sailboats and in particular to a new and improved hull form.

The action of air on a sailboat's sails exerts a tilting force sideways on the sailboat. In sailing terms, the tilt is called the sailboat's heel. Sailboat designers take heeling into account when designing boats and generally design for maximum performance at a given heel. Sailboat designers accomplish this through a combination of hull shaping and ballasting. A traditional hull shape will have the center portion protruding in a fin-like fashion vertically downwards. In a small sailboat, a dagger board protruding vertically downwards through the center of the hull is often used. A traditional hull shape provides lateral resistance in the water to any sudden tilting forces as may be caused by a sudden wind gust or changeable water conditions. The hull shape also minimizes yaw and provides excellent handling conditions under a wide range of air and sea conditions. To offset the underlying tilting forces exerted by constant and steady winds, ballast is used in the hull. The ballast is generally concentrated in the downward protrusion of the hull. The ballast below the waterline is meant to offset the weight of the mainmast, sails, rigging and the forces exerted on them by the wind and sea. In theory, therefore, heel is controlled for a wide range of air conditions by hull shaping and ballasting.

Sailboats, however, are inherently unstable due to their narrow beams. They still capsize despite the best efforts of sailboat designers to add stability. Many boat designs have been put forth to increase sailboat stability. Multihull boats such as catamarans and trimarans are common. Outriggers and pontoons have been used for years. These types of boats, while stable, tend to be difficult to hold on the vertical axis and can be difficult to handle in high seas. Another approach has been the use of rear horizontally extending fins such as disclosed in U.S. Pat. No. 2,218,264 to H. H. Luce. A similar approach is used in the Mexican styled "Pangas". Pangas are open displacement boats twenty to thirty feet in overall length, with a pair of porpoise-like fins that sprout laterally from the boat's skeg a few inches below the waterline. An inherent limitation in the use of rearward horizontal fins on a boat is the tendency of the boat to leap frog during high seas or high speeds. Although the above design approaches, i.e., muliple hulls, pontoons, rearward horizontal fins, etc., add stability to a sailing craft, the handling ability of a traditionally designed, single hull sailboat in a wide range of weather conditions is sacrificed.

SUMMARY OF THE INVENTION

The present invention comprises a sailboat with a new and improved hull whereby the lower hull and keel portions, including ballast, of a traditionally designed sailboat are extended rearward so that the center of gravity of the sailboat is moved rearward. By extending the distance between the above water forces, i.e., the mainmast with sails and rigging and wind forces on it, and the countervailing below water forces, i.e., ballast and hull shape, a greater inertia about the sailboat's longitudinal axis must be overcome by the above water forces in order to laterally tilt the sailboat. The extension of the lower hull rearward thereby provides more resistance to tilting and thereby a more stable heel.

Accordingly, an object of this invention is to provide a new and improved hull design.

Another object of this invention is to provide a means for obtaining a more stable heel.

Another object of the present invention is to retain the general handling characteristics of traditionally designed, single hull sailboats.

A more specific object of this invention is to provide a new hull form whereby the lower hull and keel, including ballast, are extended rearward so that a more stable heel is obtained.

Other objects and features of the present invention will become apparent from the following detailed description considered in connection with the accompanying drawings which will disclose an embodiment of the invention.

DESCRIPTION OF THE PREFERRED EMBODIMENT

Figure 1:
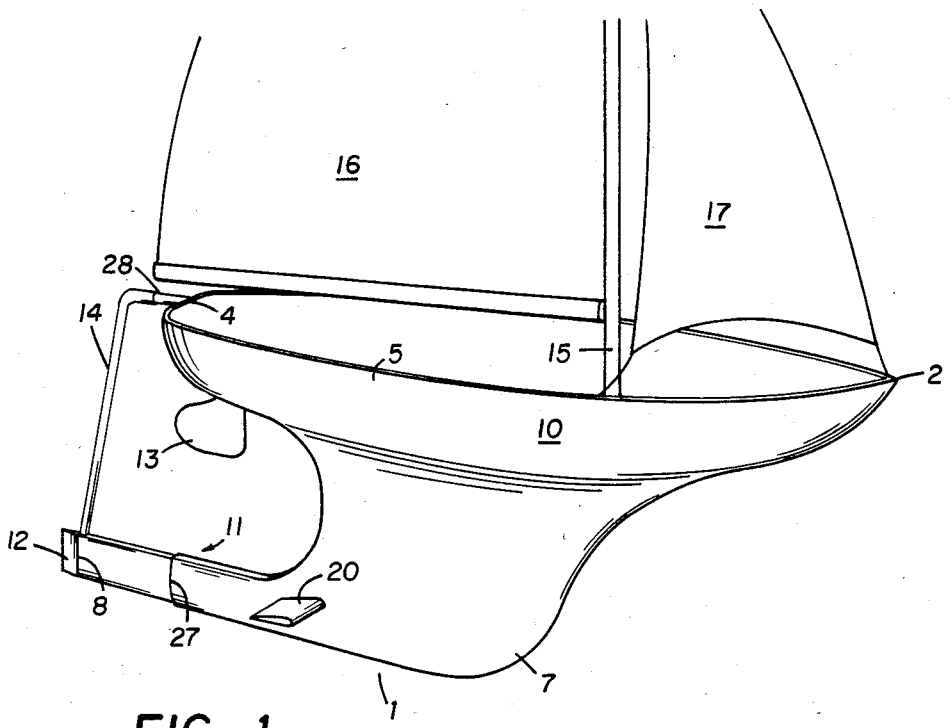
FIG. 1 is a perspective view of one embodiment of the present invention.
Figure 2:
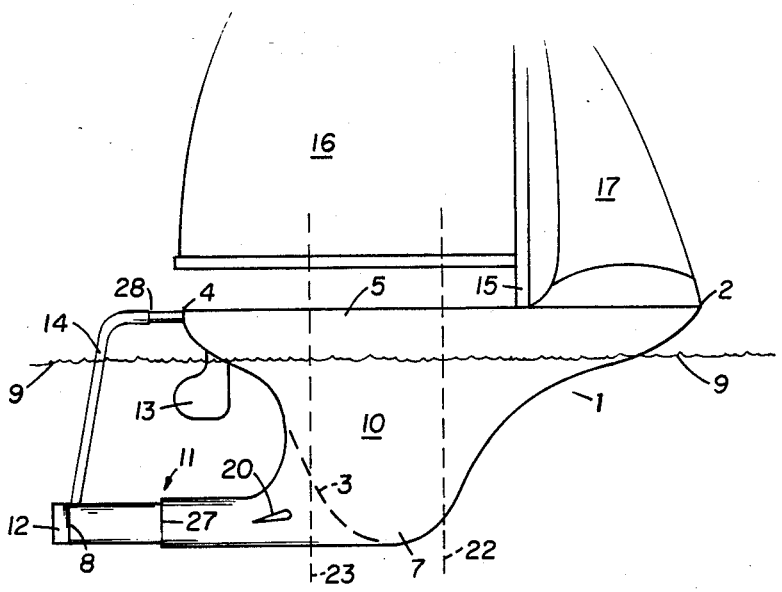
FIG. 2 is a side view of the sailboat of FIG. 1 showing in particular the shape of the hull.

Referring more particularly to the drawings in detail, wherein like numerals indicate like elements, reference numeral 1 refers generally to a sailboat having the new and improved hull form comprising one embodiment of the present invention. FIG. 1 is a perspective view of this embodiment of the invention and FIG. 2 is a side view of the sailboat of the present invention showing in particular the hull 10. Visible also for reference purposes are the lower portions of the mainmast 15, main sail 16, and jib 17. That portion of the hull 10 from the bow 2 to the line 3 defines generally a traditional hull shape 5. The center portion 7 of the traditional hull shape 5 protrudes in fin-like fashion vertically downwards. The center portion 7 is also heavily ballasted in a traditional design so that the sailboat's center of gravity 22 is just aft of the mainmast 15. The present invention's hull 10 sweeps the lower center portion 7 of the traditional hull 5 backwards below and past the rudder 13 and visible stern 4 in a vertical finlike fashion along a longitudinal axis parallel to the sailboat's 1 longitudinal axis. This has the effect of moving the sailboat's center of gravity from the traditional center of gravity 22 to a resulting center of gravity 23 closer to the visible stern 4. The backwards sweep 11 of the hull 10 in this embodiment of the invention is up to a fifth of the sailboat's overall length, from bow 2 to the aft end 8 of the rearwardly extended hull 10.

Because such a significant portion 11 of the hull 10 extends past the visible stern 4 below the water line 9, light weight, highly visible tubing 14 is attached to the visible stern 4 and extended aft and down to the end 8 of the extended hull 10. This provides a warning to other boaters not to cut too close to the visible stern 4 of the invention 1. Control of the sailboat 1 is by means of a conventional rudder 13. Because of the length of the hull shape 10, the sailboat 1 will track on course more closely. The longer a given hull, the less inclination it has to yaw. Therefore, a finer steering control is needed for slight course corrections than is provided by a conventional rudder 13. This is accomplished by the addition of a trim tab 12 to the aft end 8 of the hull 10 extension 11. The trim tab 12 is a vertical fin and is controlled on a vertical axis on one side by conventional means, either mechanically or with cables. On larger sailboats, hydraulics may be appropriate.

To offset the "nose-up" effect moving the sailboat's 1 center of gravity 23 back toward the visible stern 4 will have on the bow 2 of the sailboat while it is moving, small horizontal fins 20 extend laterally from the rearward portion of the hull 10. This will tend to lift the aft portion of the sailboat 1 while it is moving. To eliminate the "nose-up" effect while the sailboat 1 is docked or is at anchor, the rearward portion 11 of the hull 10 is telescopically adjustable in a forward and aft direction on a longitudinal axis at the junction indicated by reference line 27. The telescoping action can easily be accomplished with conventional means, mechanically or hydraulically. The aft tubing 14 would also be telescopically adjustable along the juncture 28. In this embodiment of the invention, ballast would be contained in the rearward extension 11 of the hull 10, thereby providing ballast control with the telescopic adjustments of the hull extension 11. Other means of ballast control may be easily devised. While at anchor, the hull extension 11 would be brought inward in a forward direction, thereby moving the sailboat's 1 center of gravity 23 forward from the visible stern 4 toward the mainmast 15.

Figure 4:
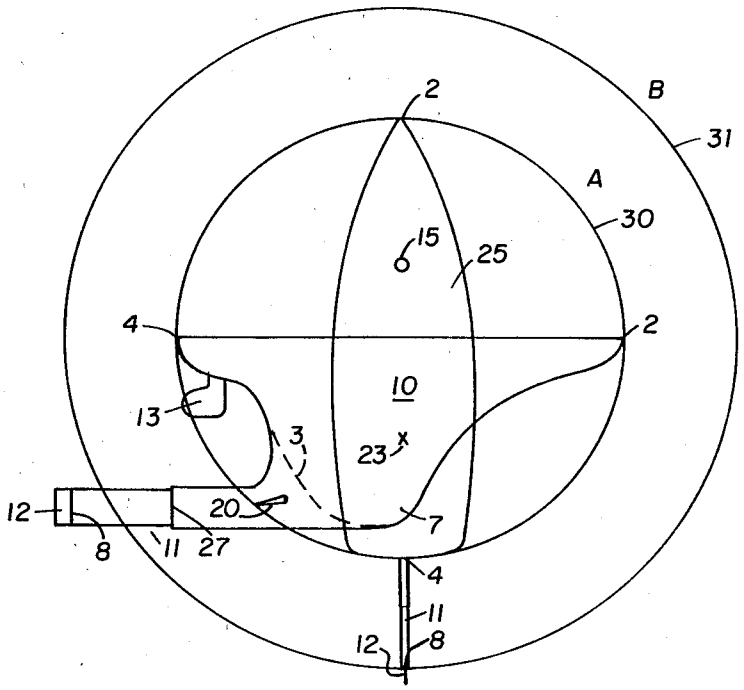
FIG. 4 is a diagramatic view of the present invention's hull showing a side view superimposed on a top view.
Figure 3:
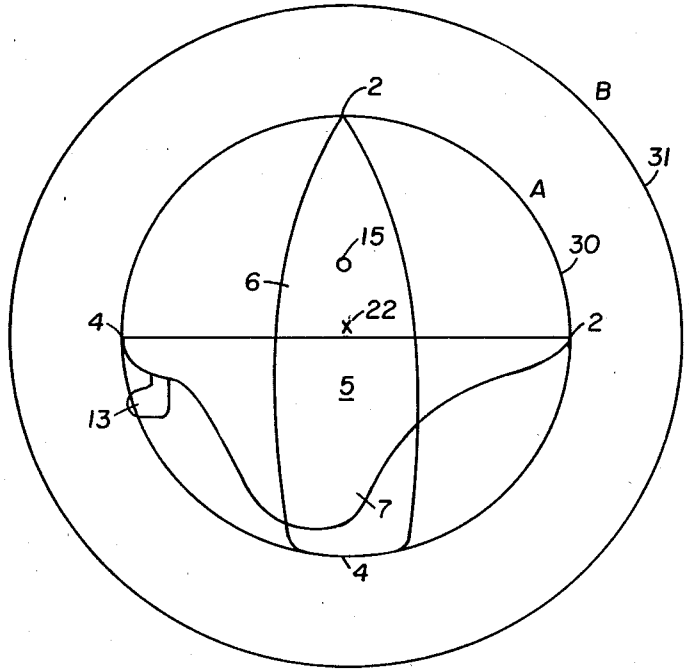
FIG. 3 is a diagramatic view of a traditionally designed sailboat hull showing a side view superimposed on a top view.

FIG. 3 is a diagramatic view of a traditionally designed sailboat hull showing a side view 5 superimposed on a top view 6. The hull shape 5 corresponds to the traditionally shaped segment 5 described in FIG. 2. Circle A 30 defines the dimensions of the longitudinal axis of both views 5 and 6. FIG. 4 is a corresponding diagramatic view of the present invention 1 showing a side view of the hull 10 superimposed on a top view 25. Circle A 30 defines the dimensions of the longitudinal axis of a traditional hull 5 and that portion of the present invention 1 visible above the water line 9. The radius of Circle B 31 plus the radius of Circle A 30 defines the overall length along the longitudinal axis of the present invention's hull 10 from bow 2 to the aft end 8 of the rearward extension 11 of the invention's hull 10. The radius of Circle A 30 is two-thirds the radius of Circle B 31. The ballast of the center portion 7 of the traditional hull 5 is moved aft thereby moving the center of gravity from a point 22 just aft of the mainmast 15 to a point 23 close to the periphery of Circle A 30.

Figure 5B:
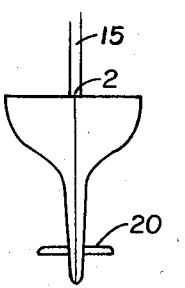
FIGS. 5*a* and 5*b* contain schematic front elevational views of a traditionally designed sailboat and a comparable sailboat of the present invention both showing a mast and hull.
Figure 5A:
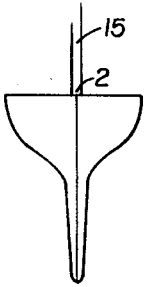

FIG. 5*a* is a schematic front elevational view of a traditionally designed sailboat hull. FIG. 5*b* is a corresponding view of the present invention. As can be seen from these figures and FIG. 4, the hull extension 11 follows the fin-like contours of the center portion 7 of the traditional hull 5 with only the present invention's rearward fins 20 laterally protruding. By moving the center of gravity 23 of the sailboat toward the visible stern 4, greater force is needed to tilt the sailboat. The yawing tendencies of this arrangement are offset by the longer hull 10 and the trim tab 12. Therefore, a more stable heel is obtained while the general handling characteristics of traditionally designed, single hull sailboats are retained.

It is understood that the above-described embodiment is merely illustrative of the application. Other embodiments may be readily devised by those skilled in the art which will embody the principles of the invention and fall within the spirit and scope thereof.

We claim:

1. A new and improved sail boat hull of the type having a bow and stern visible above the water line, a rudder below the water line, and a hull substantially beneath the water line, generally tapered so that a center portion of the hull protrudes in fin-like fashion vertically downwards and which center portion contains ballast arranged so that the sailboat's center of gravity is approximately at the midpoint of the sailboat, the improvement comprising:

a lower hull extension having a general fin-like shape extending rearward of the visible stern, below the rudder, along a telescopically adjustable longitudinal axis parallel to the longitudinal axis of the sailboat;

a ballast arrangement in said lower hull extension whereby the center of gravity of the sailboat is moved from the sailboat's midpoint toward the stern;

a means for distributing ballast to correspond with the telescopic changes in the lower hull extension consisting in the ballast in the lower hull extension being so arranged and attached to the lower hull extension that telescopic fore and aft adjustment of the lower hull extension will correspondingly adjust ballast providing a resultant fore and aft adjustment of the sailboat's center of gravity;

a plurality of horizontal fins extending laterally from either side of the lower hull extension;

a vertical trim tab pivotally attached to the aft end of the lower hull extension; and a plurality of tubes attached to the visible stern and extending aft and down to the aft end of the lower hull extension.

2. A new and improved sailboat hull as recited in claim 1, wherein:

the tubes are telescopically adjustable to correspond with telescopic adjustments in the lower hull extension.

* * * * *